US005175991A

United States Patent [19]

Stahlecker

[11] Patent Number: 5,175,991

[45] Date of Patent: Jan. 5, 1993

[54] ARRANGEMENT FOR PNEUMATIC FALSE-TWIST SPINNING

[75] Inventor: Fritz Stahlecker, Josef-Neidhart-Strasse 18, 7347 Bad Überkingen, Fed. Rep. of Germany

[73] Assignees: Fritz Stahlecker; Hans Stahlecker, both of Fed. Rep. of Germany

[21] Appl. No.: 645,562

[22] Filed: Jan. 24, 1991

[30] Foreign Application Priority Data

Feb. 10, 1990 [DE] Fed. Rep. of Germany ..... 4004045

[51] Int. Cl.[5] ..... D01H 5/00; D01H 7/92; D01H 13/02

[52] U.S. Cl. ..... 57/328; 57/90

[58] Field of Search ..... 57/350, 333, 328, 331, 57/352, 408, 411, 304, 315; 19/263

[56] References Cited

U.S. PATENT DOCUMENTS 4,124,972 11/1978 Arai et al. ..... 57/350 X
4,569,193 2/1986 Anahara et al. ..... 57/333 X
4,658,574 4/1987 Vignon ..... 57/304 X
4,672,800 6/1987 Fehrer ..... 57/328 X
4,779,410 10/1988 Fehrer ..... 57/408 X
4,858,420 8/1989 Stahlecker et al. ..... 57/350 X
4,953,349 9/1990 Fehrer ..... 57/352 X

FOREIGN PATENT DOCUMENTS 3631400 3/1988 Fed. Rep. of Germany ..... 57/350

*Primary Examiner*—Daniel P. Stodola
*Assistant Examiner*—Michael R. Mansen
*Attorney, Agent, or Firm*—Evenson, Wands, Edwards, Lenahan & McKeown

[57] ABSTRACT

In an arrangement for pneumatic false-twist spinning, an intake nozzle, a suction roller and a false-twisting nozzle are arranged between a drafting unit and a withdrawal device in a false-twisting zone. The suction roller is driven to rotate at a circumferential speed which is higher than the delivery speed of the drafting unit and the withdrawal speed of the withdrawal device.

21 Claims, 1 Drawing Sheet

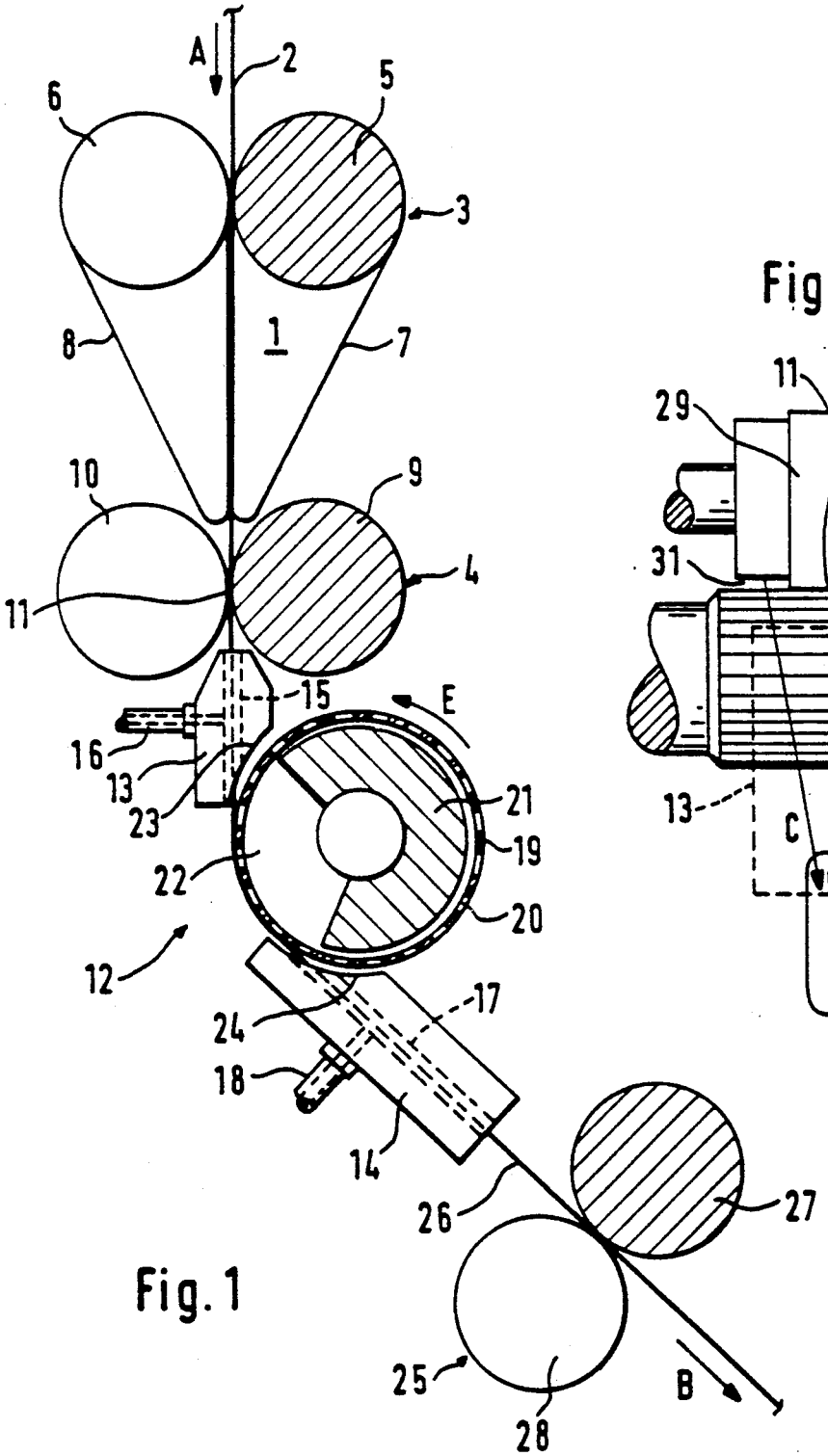
Fig. 1
Fig. 2
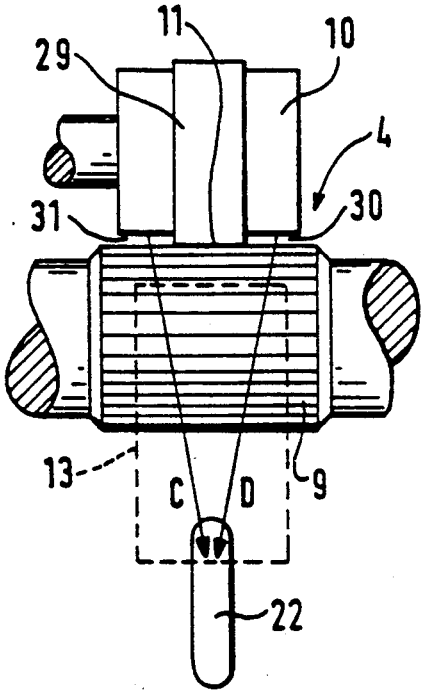

ARRANGEMENT FOR PNEUMATIC FALSE-TWIST SPINNING

BACKGROUND AND SUMMARY OF THE INVENTION

The invention relates to an arrangement for pneumatic false-twist spinning having a false-twisting zone which is situated between a drafting unit and a withdrawal device and which comprises an intake nozzle following the drafting unit and a false-twisting nozzle in front of the withdrawal device, between which a suction roller is arranged which is used as a yarn guide and is driven to perform a movement in the travelling direction of the yarn.

In the case of a known arrangement of the initially mentioned type (see German Patent Document DE-A 36 31 400, FIG. 25), a suction roller is arranged between an intake nozzle and a false-twisting nozzle by means of which it is to be at least partially prevented that the twist provided to the sliver by the false-twisting nozzle moves back. This has the purpose of improving the spreading-away of the fiber ends. The circumferential speed of the drivable suction roller corresponds to the delivery speed of the drafting unit.

It is an object of the invention to develop an arrangement of the initially mentioned type in such a manner that a yarn is obtained that has an increased strength and a more uniform appearance.

This object is achieved according to the invention in that the suction roller is driven to rotate at a circumferential speed which is higher than the delivery speed of the drafting unit and the withdrawal speed of the withdrawal device.

Because of this construction, the edge fibers are taken along by the suction roller at an increased speed in comparison to the core, the speed of which is determined by the delivery speed of the drafting unit and the withdrawal speed of the withdrawal device. These edge fibers are therefore wound in a defined form around the core which, because of the false twist provided by the false-twisting nozzle, rotates around its axis on the circumference of the suction roller. After the false twist has opened up, these edge fibers remain wound around the core of the yarn in the defined form so that a firm and uniform yarn is obtained.

In a further development of the invention, it is provided that the suction roller comprises a suction insert having a suction slot which extends in the circumferential direction of the suction roller from an outlet area of the intake nozzle into an inlet area of the false-twisting nozzle. This determines the area in which the ends of the edge fibers in a defined form are wound around the yarn core which rotates around its axis because of the false twist. In this case, it is advantageous for the outlet of the intake nozzle, which with its yarn duct is aligned essentially tangentially with respect to the circumference of the suction roller, to be arranged at a distance to the circumference of the suction roller, and for the suction slot of the suction roller to extend against its rotating direction at least to an area opposite the outlet of the intake nozzle. In the area of the sliver, which is freely guided between the outlet of the intake nozzle and the circumference of the suction roller, fiber ends can be spread away very uniformly by being sucked toward the circumference of the suction roller and thus obtaining a component of motion which differs from the motion of the yarn core directed tangentially to the suction roller.

In this case, it is also expedient if it is provided in a further development of the invention that the area of the outlet of the intake nozzle, on the side facing the suction roller, is open diagonally to the yarn travelling direction. It is achieved in this manner that the flow-off direction of the air quantity flowing out of the yarn duct of the intake nozzle deviates from the yarn travelling direction so that the spreading-away of the edge fibers is supported further.

In a further development of the invention, it is provided that the output of the suction insert is coordinated such with the air quantity flowing out of the intake nozzle that this air quantity is sucked at least approximately completely into the suction slot. This results in a very defined air flow in the outlet area of the intake nozzle which further supports the spreading-away of fiber ends.

In a further development of the invention, it is provided that the intake width of the suction nozzle, in the axial direction of the pair of delivery rollers of the drafting unit, is wider than the width of a covering of a pressure roller. In this case, it is particularly advantageous for the width of the coating of the pressure roller of the pair of delivery rollers to correspond essentially to the width of the drawn sliver. As a result, it is prevented that the air flow entrained by the rollers of the pair of delivery rollers of the drafting unit disturbs the fiber arrangement on the inlet side of the pair of delivery rollers. On the contrary, air currents which promote the orientation of the fiber ends are taken in through the area of the nip line of the pair of delivery rollers.

In a further development of the invention, it is provided that the air flow rate in the intake nozzle is higher than the delivery speed of the drafting unit. As a result, it is achieved that the fiber ends are, in addition, aligned toward the front in the travelling direction of the yarn. Also, fibers, which are so-called floating fibers and which, for example, are no longer clamped into the pair of delivery rollers and have not yet reached the suction roller, are guided in a more controlled manner. This development is advantageous particularly if a sliver is processed which does not have very long fibers, such as a short-staple or a medium-staple sliver.

Other objects, advantages and novel features of the present invention will become apparent from the following detailed description of the invention when considered in conjunction with the accompanying drawings.

BRIEF DESCRIPTION OF THE DRAWINGS

FIG. 1 is a partially sectional, partially lateral view of an arrangement constructed according to the invention; and FIG. 2 is a partial view in the area of the nip line of a pair of delivery rollers of the drafting unit of the embodiment according to FIG. 1, in which an intake nozzle following the drafting unit is only outlined.

DETAILED DESCRIPTION OF THE DRAWINGS

The arrangement which is partially illustrated in FIG. 1 is a part of a spinning machine which, at least on one side of the machine, is equipped with a plurality of arrangements of this type which are arranged in a row next to one another. The arrangement comprises a drafting unit 1 in which a sliver 2, which is guided through in the direction of the arrow (A), is drafted or drawn to the desired yarn size. The sliver 2 then passes through a false-twisting zone 12 in which it is spun into a yarn 26. This yarn 26 is withdrawn by a withdrawal device 25, after which it travels in the direction of the arrow (B) to a wind-up device, which is not shown and by which it is wound to a cross-wound package. Only the second to the last pair of rollers 3 and the pair of delivery rollers 4 of this drafting unit 1 are shown in FIG. 1. The two pairs of rollers 3, 4 each comprise a bottom cylinder 5, 9 which extend through in the longitudinal direction of the machine and are driven at one machine end. One pressure roller 6, 10 respectively is assigned to these bottom cylinders 5, 9, and, in a manner not shown in detail, is held by the load carrier and, by means of spring force, is pressed against the bottom rollers 5, 9. In the drafting zone between the pairs of rollers 3, 4, an apron guide is provided which comprises a bottom apron 7 and a top apron 8 which extend relatively closely into the inlet area to the nip line 11 of the pair of delivery rollers.

The withdrawal device 25 comprises a shaft 27 which extends through in the longitudinal direction of the machine and is driven at one machine end, as well as a pressure roller 28 which is held by a holder, which is not shown, and is elastically pressed against the shaft 27. The delivery speed of the pair of delivery rollers 4 and the withdrawal speed of the withdrawal device 25 determine the speed at which the drawn sliver, which is spun to a yarn 26, travels through the false-twisting zone 12. The withdrawal speed of the withdrawal device 25 corresponds approximately to the delivery speed of the pair of delivery rollers 4, in which case the withdrawal speed is preferably slightly lower so that a slight negative draft is obtained in the area of the false-twisting zone 12.

Directly behind the pair of delivery rollers 4 of the drafting unit i, an intake nozzle 13 is arranged which has a yarn duct 1 5 which is aligned as an extension of the plane of the drafting unit, that is, in the travelling direction (A). The intake nozzle 13 is equipped with a compressed-air supply line 16 which, by way of one or two blow openings, leads into the yarn duct 15, the blow opening or blow openings being arranged such that an air current is generated which takes in the sliver from the nip line 11 and which has no twist or no more than a slight twist.

The yarn duct 15 of the intake nozzle 13 is aligned tangentially with respect to the circumferential surface of a suction roller 19 which is arranged behind the intake nozzle in the travelling direction of the yarn. In a manner not shown in detail, the suction roller 19 is driven to perform a rotation in the direction of the arrow (E), in which case this drive can be diverted from the bottom cylinder 9 by way of a belt drive or a toothed belt drive or the like. The sliver winds around the suction roller 19 at an angle of slightly less than 90°. Then the sliver leaves the circumference of the suction roller 19 and travels tangentially into the yarn duct 17 of a false-twisting nozzle 14. The false-twisting nozzle 14 is connected to a compressed-air duct 18 which leads into the yarn duct 17 by way of one or several blow openings. These openings are arranged in such a manner that an air swirl is generated in the yarn duct 17 in a predetermined rotating direction which affects the sliver and provides the sliver with a false twist extending back into the area of the nip line 11. This false twist opens up again when leaving the false-twisting nozzle 14 so that then the spun yarn 26 will be present.

The suction roller 19, which is provided with a perforation 20, contains a suction insert 21 in its interior which is connected to a vacuum source which is not shown. This suction insert 21 has a relatively narrow suction slot 22 which extends in the circumferential direction from the area of the mouth or outlet of the yarn duct 15 of the intake nozzle 13 to the area of the inlet of the yarn duct 17 of the false-twisting nozzle 14. The suction roller 19 is driven in such a manner that its circumferential speed is approximately 50% higher than the delivery speed of the pair of delivery rollers 4. In the area facing the suction roller 19, the intake nozzle 13 is provided with a recess 23 which is adapted to the contour of the suction roller 19 and cuts into the yarn duct 15 in such a manner that it obtains an oblique mouth which is open in the direction of the suction slot 22 of the suction insert 21 of the suction roller 19, as illustrated. The air quantity supplied to the intake nozzle 13 is fixed in such a manner that an air current is generated in the yarn duct 15 which has a velocity which is higher than the delivery speed of the pair of delivery rollers 4. The suction slot 22 is dimensioned such, and the applied vacuum is designed such that the total air quantity flowing out of the intake nozzle 13 is sucked into the suction slot 22. The false-twisting nozzle 14, on its inlet side, is provided with a recess 24 which is adapted to the contour of the suction roller 19 so that the inlet opening of the yarn duct 17 can be moved relatively closely to the circumference of the suction roller 19.

The sliver leaving the nip line 11 of the pair of delivery rollers 4 is sucked into the yarn duct 15 of the intake nozzle 13 and extends tangentially with respect to the circumference of the suction roller 19. Fiber ends of edge fibers which are already spread away or are just loose, however, do not precisely follow this movement. In the area of the mouth of the yarn duct 15, they are deflected into the direction of the circumferential surface of the suction roller 19 because of the deflection of the air current and because of the intake by way of the suction slot 22, and are spread away in an increased manner. These loose fiber ends are taken along by the suction roller 19 at an increased speed, that is, at a speed that is increased in comparison to the core of the sliver, at least along a part of the path. These fiber ends, which therefore move ahead, are wound around the sliver which, because of the false twist provided by the false-twisting nozzle 14, rotates around its longitudinal axis and slides on the circumferential surface of the suction roller 19. In this case, these fiber ends are wound around the fiber core in a controlled form and with a controlled slope. This winding-around takes place at a slope which is in a direction opposite to the false twist of the sliver. When the false twist of the sliver opens up again behind the false-twisting nozzle, these fiber ends remain wound around the fiber core so that a very uniform spun yarn 26 is obtained.

The intake nozzle 13, in particular, has advantages when a sliver is spun that does not have very long fibers because these fibers are then guided in the area of the intake nozzle 13. This is particularly true also for so-called "floating" fibers, that is, fibers which have already left the nip line 11 of the pair of delivery rollers 4, but have not yet reached the surface of the suction roller 19. In order to promote a spreading-away of fiber ends in the area of the mouth of the yarn duct 15 of the intake nozzle 13, it is expedient for the mouth of the yarn duct 15 to maintain a distance from the circumferential surface of the suction roller 19 which corresponds to approximately $\frac{1}{3}$ to approximately $\frac{3}{4}$ of the medium fiber length of the fiber material to be processed.

In the embodiment according to FIG. 2, it is provided that the pressure roller 10 has a coating 29 which has a relatively small axial width. This axial width of the coating 29, which determines the length of the nip line 11, is only insignificantly wider than the drawn sliver. The intake nozzle 13, which is only outlined, —viewed in the longitudinal direction of the nip line 11—has an intake width which is clearly wider than the width of the coating 29. As a result, air currents are taken in laterally of the coating 29 by way of gaps 30, 31 which are represented by the arrows (C and D). Since the suction slot 22 only has a relatively small width in the axial direction of the suction roller 19, these air currents are guided together in a V-shape in the direction of the suction slot 22 either already in the intake nozzle 13 or no later than behind the intake nozzle 13. As a result, the desired orientation of the fiber ends is further improved. These air currents will naturally also be created if the pressure roller 10, as a whole, is constructed only with a width that corresponds to the width of the coating 29.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An arrangement for pneumatic false-twist spinning of a fiber strand, comprising:

a fiber strand supply unit, a false-twisting zone disposed downstream of the fiber strand supply unit, and a withdrawal device disposed downstream of the false-twisting zone, wherein the false-twisting zone includes a fiber strand intake nozzle disposed downstream of the fiber strand supply unit, a false-twisting nozzle disposed downstream of the intake nozzle and upstream of the withdrawal device, and a suction guide roller exhibiting a circumferential guide surface for guiding the fiber strand disposed between the intake nozzle and the false-twisting nozzle, and wherein the suction guide roller is driven to rotate at a circumferential speed such that its circumferential guide surface has a greater speed than the delivery speed of the fiber strand supply unit and the withdrawal speed of the withdrawal device, whereby edge fibers of a fiber strand being spun are taken along by the suction roller at an increased speed in comparison to core fibers of the fiber strand to thereby control winding around of these edge fibers when the false-twist is opened up.

2. An arrangement according to claim 1, wherein the fiber strand supply unit is a drafting unit.

3. An arrangement according to claim 2, wherein the speed of the suction roller guide surface is approximately 50% higher than the delivery speed of the drafting unit.

4. An arrangement according to claim 3, wherein the suction roller has a suction insert with a suction slot which extends in the circumferential direction of the suction roller from an outlet area of the intake nozzle to the inlet area of the false-twisting nozzle.

5. An arrangement according to claim 3, wherein the air flow velocity in the intake nozzle is higher than the delivery speed of the drafting unit.

6. An arrangement according to claim 2, wherein the suction roller has a suction insert with a suction slot which extends in the circumferential direction of the suction roller from an outlet area of the intake nozzle to the inlet are of the false-twisting nozzle.

7. An arrangement according to claim 6, wherein the intake nozzle includes a yarn duct which is aligned essentially tangentially with respect to the circumference of the suction roller, wherein an outlet opening of the intake nozzle is arranged at a distance to the circumference of the suction roller, and wherein the suction slot of the suction insert of the suction roller extends against its rotating direction to at least an area that is opposite the outlet opening of the intake nozzle.

8. An arrangement according to claim 7, wherein the are a of the outlet opening of the intake nozzle is open diagonally with respect to the yearn travelling direction on the side facing the suction roller.

9. An arrangement according to claim 8, wherein the speed of the suction roller guide surface is approximately 50% higher than the delivery speed of the drafting unit.

10. An arrangement according to claim 8, wherein the area of the outlet opening of the intake nozzle is provided with a recess which contains the outlet of the yarn duct and is adapted to the circumference of the suction roller.

11. An arrangement according to claim 7, wherein the are a of the outlet opening of the intake nozzle is provided with a recess which contains the outlet of the yarn duct and is adapted to the circumference of the suction roller.

12. An arrangement according to claim 7, wherein the air flow velocity in the intake nozzle is higher than the delivery speed of the drafting unit.

13. An arrangement according to claim 6, wherein the area of the outlet opening of the intake nozzle is provided with a recess which contains the outlet of the yarn duct and is adapted to the circumference of the suction roller.

14. An arrangement according to claim 6, wherein the pair flow velocity in the intake nozzle is higher than the delivery speed of the drafting unit.

15. An arrangement according to claim 6, wherein the output of the suction insert is adapted to the air quantity flowing out of the intake nozzle in such a manner that this air quantity is taken into the suction slot at least approximately completely.

16. An arrangement according to claim 6, wherein the width of the suction slot of the suction insert of the suction roller is smaller than the intake width of the suction nozzle.

17. An arrangement according to claim 16, wherein the intake width of the suction nozzle in the axial direction of a pair of delivery rollers of the drafting unit is wider than the width of a coating of a pressure roller of a pair of delivery rollers of the drafting unit.

18. An arrangement according to claim 17, wherein the width of the coating of the pressure roller of the pair of delivery rollers corresponds essentially to the width of the drafted sliver.

19. An arrangement according to claim 2, wherein the air flow velocity in the intake nozzle is higher than the delivery speed of the drafting unit.

20. An arrangement according to claim 2, wherein the intake width of the suction nozzle in the axial direction of a pair of delivery rollers of the drafting unit is wider than the width of a coating of a pressure roller of a pair of delivery rollers at the drafting unit.

21. An arrangement according to claim 20, wherein the width of the coating of the pressure roller of the pair of delivery rollers corresponds essentially to the width of the drafted sliver.

* * * * *